US009126424B2

(12) United States Patent
Coffin et al.

(10) Patent No.: US 9,126,424 B2
(45) Date of Patent: Sep. 8, 2015

(54) INKJET PRINTING PLATEN

(71) Applicant: Hewlett-Packard Development Company, L.P., Houston, TX (US)

(72) Inventors: Paul Coffin, Battle Ground, WA (US); Wesley R Schalk, Camas, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 13/746,161

(22) Filed: Jan. 21, 2013

(65) Prior Publication Data

US 2014/0204164 A1 Jul. 24, 2014

(51) Int. Cl.

| | |
|---|---|
| ***B41J 2/01*** | (2006.01) |
| ***B41J 3/60*** | (2006.01) |
| ***B41J 11/06*** | (2006.01) |

(52) U.S. Cl.

CPC ... *B41J 3/60* (2013.01); *B41J 11/06* (2013.01)

(58) Field of Classification Search

CPC ..... B41J 11/06; B41J 11/08

See application file for complete search history.

(56) References Cited

U.S. PATENT DOCUMENTS

| | | | | |
|---|---|---|---|---|
| 6,467,900 | B1 | 10/2002 | Askren et al. | |
| 6,623,093 | B2 | 9/2003 | Takahashi et al. | |
| 7,527,346 | B2 * | 5/2009 | Izuchi | 347/16 |
| 2007/0109384 | A1 * | 5/2007 | Takeda et al. | 347/104 |
| 2011/0129278 | A1 | 6/2011 | Muir et al. | |
| 2012/0242744 | A1 | 9/2012 | Sutton et al. | |

FOREIGN PATENT DOCUMENTS

| | | |
|---|---|---|
| DE | 4119844 | 2/1992 |
| KR | 20110067605 | 6/2011 |

OTHER PUBLICATIONS

Chen, et al. A High-Resolution Silicon Monolithic Nozzle Array for Inkjet Printing. IEEE Transactions on Electron Devices, vol. 44, No, 9. Sep. 1997.

* cited by examiner

*Primary Examiner* — Justin Seo

(74) *Attorney, Agent, or Firm* — Clifton L. Anderson

(57) ABSTRACT

An inkjet printing process includes advancing a print medium so that it contacts a relatively high-contact area of a platen. After the print medium first contacts the relatively high-contact area, ink is deposited on a side of the medium not contacting the platen to form an image. The print medium continues to advance so that the image passes over a relatively low-contact area of the platen.

21 Claims, 3 Drawing Sheets

INKJET PRINTING PLATEN

BACKGROUND

In a typical inkjet printer, a print head deposits ink onto a surface of a print medium to form print images, e.g., including text. A page-wide print head can print the width of a page without moving, while a moving print head can be moved along the width of the page. In either case, the print head is designed to print a band or "swath" at a time. A media-advance mechanism advances the media longitudinally past the print head so that the image can extend longitudinally along the medium. (Herein, "length" and "width" refer to dimensions respectively along and transverse to the direction of media travel during printing, regardless of the media dimensions.)

As the print medium passes the print head, it is typically supported on the side opposite the print head by platen, so that the medium is a known distance from the print head. An inkjet platen may support the medium on a series of ribs. Gaps between the ribs can accommodate a possible deformation of the print media as wet ink is deposited. Without the gaps between the ribs, any deformation of the media would be toward the print head, which would have a more deleterious impact on print quality.

BRIEF DESCRIPTION OF THE DRAWINGS

The following figures represent examples and not the invention itself.

DETAILED DESCRIPTION

Inkjet printing is a "wet" process, so some time is required for ink to dry. To keep print throughput at acceptable levels, attempts are made to keep drying latencies before the second side is printed to a minimum. As a result, the first side may be partially dry but not completely dry as the second side is being printed.

It is now recognized that some inkjet platens can degrade the image on the first printed side of a duplex printing job as the second side is being printed. As the second side is being printed, the platen ribs can smear and scratch a freshly printed first side image. Furthermore, the platen ribs may redeposit onto the first-printed side or second non-printed side ink previously deposited on the ribs (e.g., due to contact with an image, or due to ink deposited directly from a print head at the edges of a "borderless" image that extends to the medium edges).

Figure 1:
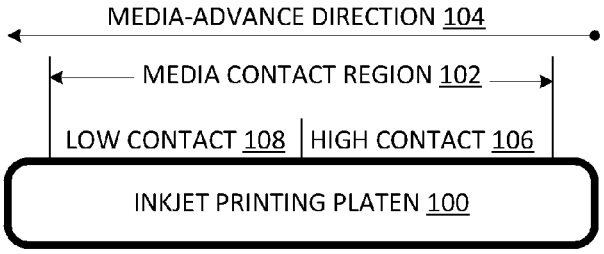
FIG. 1 is a schematic diagram of an inkjet printing platen in accordance with an example.

To address this image-degradation, an inkjet printing platen 100, shown in FIG. 1, includes a media contact region 102 that is contacted by media as it travels in a media-advance direction 104 by a print head. The media contact region 102 includes a relatively high-contact area 106 and a relatively low-contact area 108.

Herein, "high" and "low", as applied to "contact area" refer to a degree of contact that can be measured as a percentage of an area covered by a print medium in actual contact with the print medium. In the examples herein, the degree of media contact with the platen is higher upstream and lower downstream in the direction of media travel as the second side is being printed.

Figure 2:
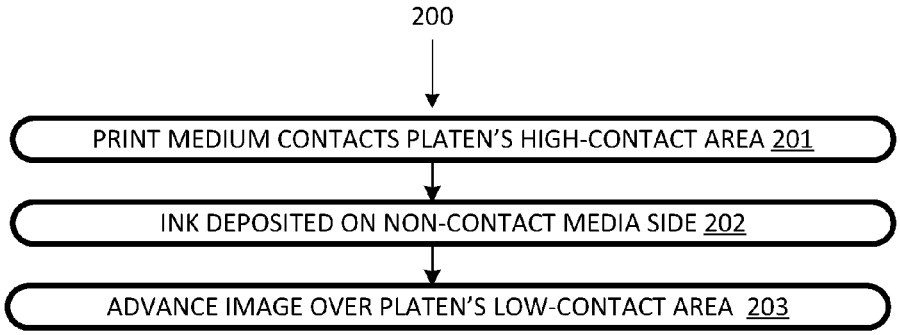
FIG. 2 is a flow chart of an inkjet printing process in accordance with an example.

Platen 100 can be used in a process 200, flow charted in FIG. 2. At 201, media is advanced so that it first contacts the platen in the relatively high-contact area. At 202, while the media is in contact with the platen, ink is deposited on the side of the medium not in contact with (i.e., facing away from) the platen; this results in an image (i.e., printed area) of the medium. At 203, the media is advanced so that the image advances over the relatively low-contact area of the platen. Platen 100 can be used with other processes and process 200 can be used with other platens.

The material for the high-contact area may or may not be different from the material for the low-contact area. The high-contact area can have low surface friction, e.g., lower than the surface friction of drive elements and the low-contact area. In addition, the high-contact area can be hydrophobic to resist wetting with ink. For example, the high-contact area can be a metal, such as stainless steel or aluminum, or a low-friction plastic such as a hydrophobic (e.g., modified with a hydrophobic moiety to minimize wetting by incompletely dry ink) polyoxymethylene (acetal). In examples in which the high-contact and low-contact areas are of different (structural or coating) materials, the material of the high-contact area is more hydrophobic and is characterized by lower friction than the material of the low-contact area.

Figure 3A:
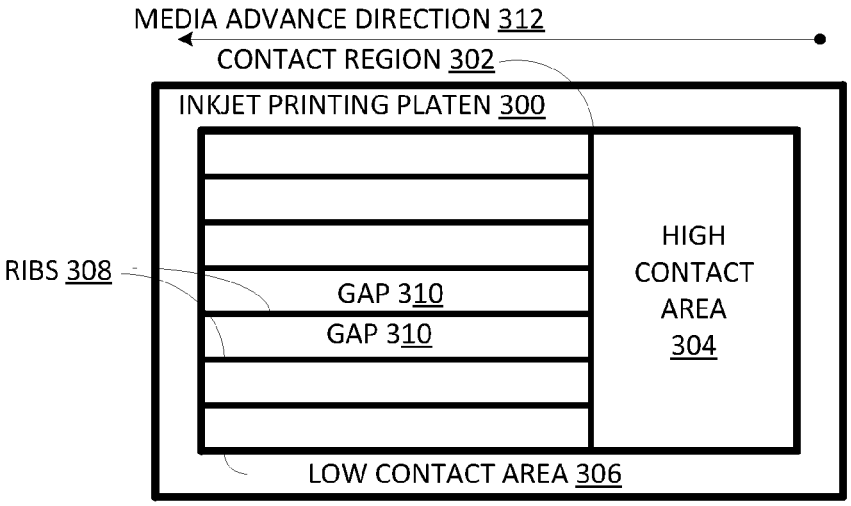
FIG. 3A is a schematic illustration of a platen including smooth relatively high-contact area and a ribbed relatively low-contact area in accordance with an example.
Figure 3B:
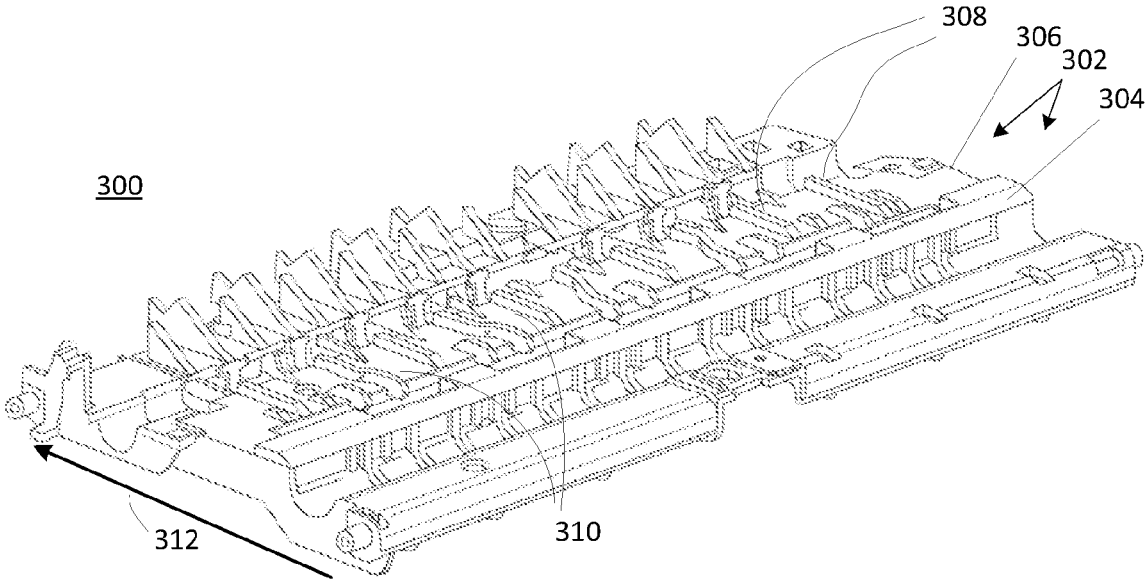
FIG. 3B is a perspective view of the platen of FIG. 3A.

For example, an inkjet printing platen 300, shown in FIGS. 3A and 3B, includes a contact region 302 with a smooth relatively high-contact area 304 and a ribbed relatively low-contact area 306. Relatively low-contact area 306 includes ribs 308 separated by gaps 310. Media traveling in direction 312 first contacts smooth relatively high-contact area 304, where substantially the full width of the medium is in contact with plate 300. Downstream, the media contacts ribbed relatively low-contact area 306, where the medium only contacts the ribs; portions of the media over gaps 310 would not be in contact with the platen.

The entire contact area for platen 300 belongs to a monolithic molded component. Platen 300 may contain other components, but these do not contact media under normal usage conditions. In other examples, the relatively low-contact area and the relatively high-contact area belong to separately formed components.

To control the gap between the print head and the medium, the forces on the medium are typically greatest when the medium first contacts the (contact region of) the platen. However, the force is spread over the high-contact-area width of the medium. Thus, the maximum pressure (force divided by area) at any given transverse position of the medium is kept relatively low. Keeping the maximum pressure relatively low helps minimize image impairment of a previously printed side of the print medium during duplex printing of the second side. As the medium progresses to the low-contact area, the total force to which the medium is subject is reduced; therefore, the contact can be less uniform while maintaining a sufficiently low pressure to avoid impairing a freshly printed image.

When the first side of the medium is printed, the medium may warp as it is wetted by ink. This wetting occurs only at, and downstream of, the print head. Thus, by the time any warping would occur, the print medium is over ribbed relatively low-contact area 306 so that gaps 310 can accommodate any such warping. Thus, platen 300 accommodates warping during first-side printing with its ribbed area, and minimizes image-threatening maximum pressures during second-side printing. In an example, the spacing between the print head and the platen is increased during second-side printing to avoid impairing the freshly printed image.

Figure 4:
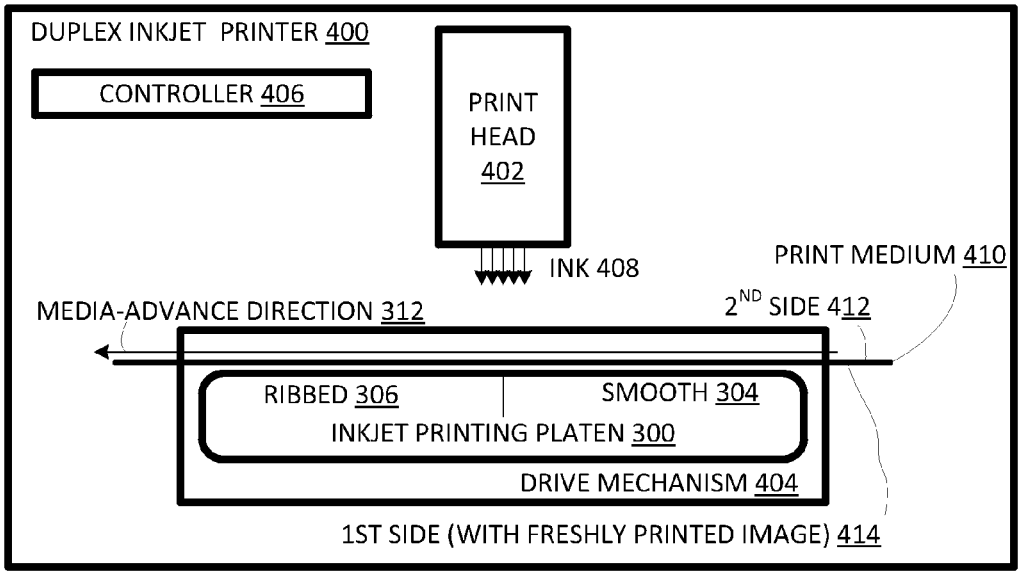
FIG. 4 is a schematic illustration of a duplexing inkjet printer in incorporating the platen of FIGS. 3A-B in accordance with an example.

Platen 300 may be incorporated into a duplex inkjet printer 400, shown in FIG. 4. Duplex inkjet printer 400 includes a print head 402, a drive mechanism 404, and a controller 406. Controller 406 receives print commands and coordinates the actions of print head 402 and drive mechanism 404 accordingly to form images by depositing ink 408 on a print medium 410.

Drive mechanism 404 includes platen 300 and other sub-mechanisms to transport print media, including print medium 410, relative to platen 300 and print head 402. During printing, drive mechanism 404 advances medium 410 in forward print direction 312. Drive mechanism 404 can continue to advance medium 410 in direction 312 beyond platen 300, and then reverses media direction to direct the medium into a duplex path that flips the media before the media recontacts the platen so that the second side can be printed. In an alternative example, the medium is transported in the reverse direction past the platen in preparation for flipping the print medium so that, after a first side of medium is printed, the second side of medium can be printed. At the time represented in FIG. 4, second side 412 is being printed while freshly printed (i.e., partially, but not completely, dried) first side 414 is in contact with platen 300.

Figure 5:
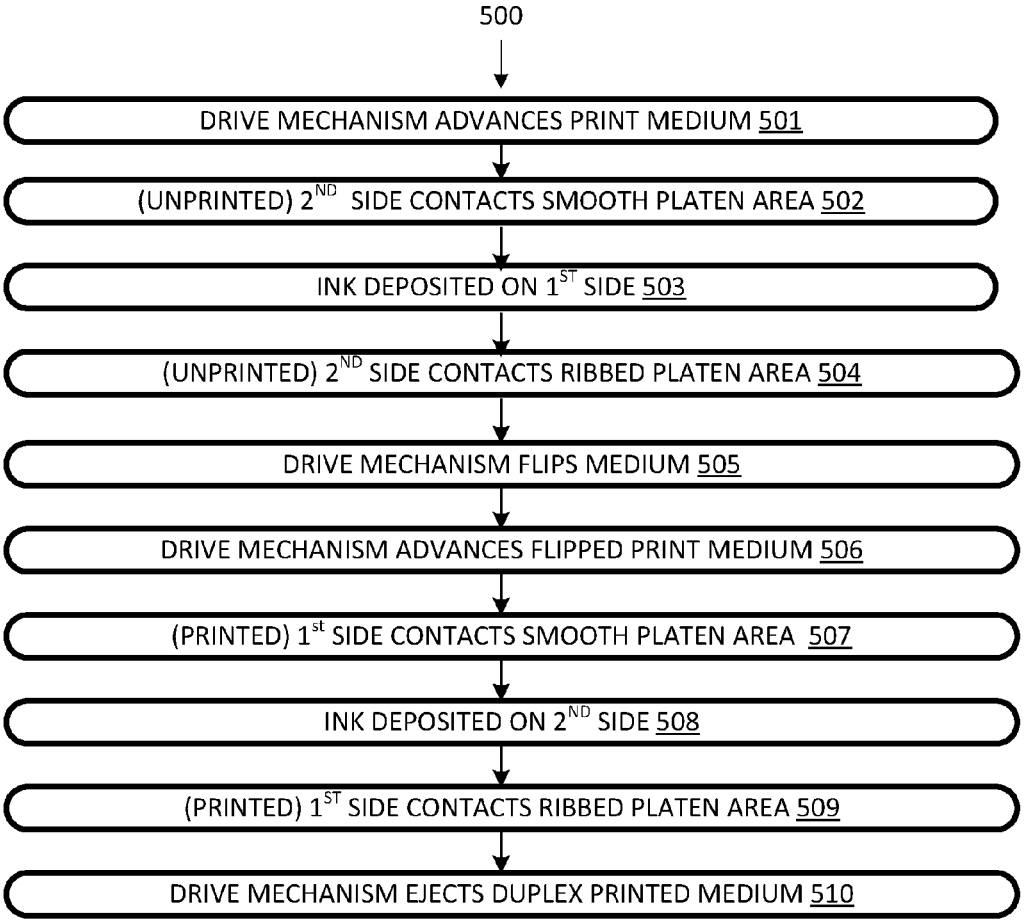
FIG. 5 is a flow chart of a process implementable by the duplexing inkjet of FIGS. 3A-B printer in accordance with an example.

Duplex printer 400 can implement an inkjet printing process 500, flow charted in FIG. 5. At 501, the drive mechanism advances a print medium in the forward direction in which media is printed. At this point, the print medium has not been printed on either side. In some scenarios, one or both sides of the medium can contain some pre-printed material, e.g., letterhead. The print medium is oriented so that the "first" side is to be printed first.

At 502, the (unprinted) second side of the medium contacts the smooth relatively high-contact area of the platen. As explained further below, in some printers, the relatively high-contact area is not smooth. Since there is no freshly deposited ink at this point, there is no problem with warping due to wetting and no problem due to image impairment by the platen. Note that, while action 502 begins after action 501 begins, their respective durations overlap with each other and with the durations of actions 503 and 504.

At 503, a print head is operated so that ink is deposited on the first side of the medium to form an image (e.g., text, non-text, or mixed text and non-text). In some examples, there can be multiple print heads, e.g., for respective different colors of ink. Also, the print head can be moving non-moving, e.g., full-medium-width.

At 504, the unprinted second side contacts the ribbed area of the platen. The image resulting from the ink deposition at 503 advances over the ribbed area. At this point, the second side is unprinted so contact with the platen does not disturb an existing image. However, the first side is being wetted by ink, so the gaps between the ribs can accommodate warping that may occur as a result of the wetting. At the end of 504, an image is fully formed on the first side of the print medium.

At 505, the drive mechanism automatically flips the print medium, e.g., using one of the approaches described above. In an alternative example, a user manually flips the media and inserts it into a drive mechanism of a non-duplex or duplex printer.

Actions 506-509, which result in the second side being printed, correspond respectively to actions 501-504, used to print the first side. At 506, the drive mechanism advances the (now flipped) print medium. At 507, the (now printed) first side contacts the smooth relatively high-contact area of the platen. The drive mechanism forces the medium against the platen; this force tends to be greatest near the first-contacted area of the platen. If this force were distributed unevenly across the width of the medium, there would be high localized forces that could scrape and smear freshly deposited ink. However, in duplex printer 400, this risk of impairment is substantially reduced since the smooth relatively high-contact area of the platen distributes the forces widthwise so that the maximum local forces are kept relatively low.

At 508, the print head deposits ink on the second side of the medium. Depending in part on what was printed on the first side, this second-side printing may or may not cause additional warping of the medium. In any event, any such warping can be handled by the gaps between the ribs as the now duplex printed medium is driven over the ribbed relatively low-contact area of the platen at 509 so that the image is advanced over the ribbed area (as and after it is being printed). At 510, the drive mechanism ejects the duplex-printed medium so that it can be accessed by a user.

In some examples, the print head deposits ink on an area of the medium while the medium area is over the smooth platen area. In other examples, the print head deposits ink on a print area of the medium that is over the ribbed platen area. In still other examples, the print head prints on an area of the medium that straddles the smooth and ribbed areas of the platen.

While platen 300 achieves a relatively low maximum contact contact area using a smooth surface, other examples achieve a similar objective without using a smooth surface. In some examples, ribs are widened to increase the area of contact. Thus, a medium can first contact wide ribs that become increasingly narrower as the medium advances across the platen. For example, rib width at the entry media entry point can be two, three or more times as wide as they are nearer to the exit point of the contact region.

Herein, a "system" is a set of interacting non-transitory tangible elements, wherein the elements can be, by way of example and not of limitation, mechanical components, electrical elements, atoms, physical encodings of instructions, and process actions. Herein, "process" refers to a sequence of actions resulting in or involving a physical transformation. Herein, unless otherwise apparent from context, a functionally defined component (e.g., "controller") is a combination of hardware and software executing on that hardware to provide the defined functionality.

Herein, "print medium" and "print media" refer to a material on which ink can be deposited to form an image. Herein, "printed image" refers to any distribution of ink on a medium, whether or not the image is meaningful in any way. An image may include text, graphics, and other elements. A "freshly printed image" is an inkjet image for which the ink is not yet fully dried. "Media-advance direction" refers to a direction of media travel as ink is being deposited on a print medium.

Herein "ribs" means raised portions; for example, a medium would contact the tops of ribs, whereas the portions of the medium over gaps between the ribs would not in general be in contact with the walls and bottom of gaps. Herein, "smooth" means "free from perceptible projections and indentations".

In this specification, related art is discussed for expository purposes. Related art labeled "prior art", if any, is admitted prior art. Related art not labeled "prior art" is not admitted prior art. The illustrated and other described embodiments, as well as modifications thereto and variations thereupon are within the scope of the following claims.

What is claimed is:

1. An inkjet printing process comprising:

advancing a print medium so that it contacts a relatively high-contact area of a platen;

after the print medium first contacts the relatively high-contact area, depositing ink on a side of the print medium not contacting the platen to form an image; and advancing a printed area of the print medium so that the image advances over a relatively low-contact area of the platen, the relatively high-contact area being more hydrophobic than the relatively low contact area, the relatively high-contact area being of a different material than the relatively low-contact area, wherein the terms relatively high-contact area and relatively low-contact area refer to a degree of a percentage of an area of the platen, covered by the print medium, that is in actual contact with the print medium.

2. An inkjet printing process as recited in claim 1 wherein, during the advancing of the print medium, a side of the print medium contacting the platen bears a freshly printed image.

3. An inkjet printing process as recited in claim 1 wherein the relatively low-contact area includes ribs and intervening gaps.

4. An inkjet printing process as recited in claim 3 wherein the relatively high-contact area is smooth.

5. An inkjet printing process as recited in claim 1 further comprising:

automatically flipping the print medium;

advancing the print medium so that the image contacts the relatively high-contact area of the platen;

depositing ink on the side of the print medium opposite the image;

advancing the print medium so that the image contacts the relatively low-contact area of the platen.

6. An inkjet printing process as recited in claim 5 wherein:

the advancing the print medium so that the printed area contacts the relatively low-contact area of the platen includes:

ink of the printed area contacting ribs of the relatively low-contact area; and the relatively high-contact area of the platen is smooth.

7. An inkjet printing platen for supporting a medium as ink is being deposited on the medium, the platen comprising:

a relatively high-contact area and a relatively low-contact area, the relatively low-contact area being disposed downstream of the relatively high-contact area along a media-advance direction, the relatively high-contact are being more hydrophobic than the relatively low contact area, the relatively high-contact area being of a different material than the relatively low-contact area, wherein the terms relatively high-contact area and relatively low-contact area refer to a degree of a percentage of an area of the platen, covered by the medium, that is in actual contact with the medium.

8. An inkjet printing platen as recited in claim 7 wherein the relatively high-contact area has at least twice a contact percentage of the relatively low-contact area.

9. An inkjet printing platen as recited in claim 7 wherein the relatively low-contact area has ribs.

10. An inkjet printing platen as recited in claim 8 wherein the relatively high-contact area is smooth.

11. An inkjet printer comprising:

a print head for depositing ink on a medium to form an image; and a drive mechanism for advancing the medium past the print head in a media-advance direction, the drive mechanism including a platen having a contact region that the medium contacts as it is advanced past the print head, the contact region including, a relatively high-contact area, and a relatively low-contact area, the relatively low-contact area being disposed downstream of the relatively high-contact area along the media-advance direction, the relatively high-contact area being more hydrophobic than the relatively low-contact area, the relatively high-contact are being of a different material than the relatively low-contact area, wherein the terms relatively high-contact area and relatively low-contact area refer to a degree of a percentage of an area of the platen, covered by the medium, that is in actual contact with the medium.

12. An inkjet printer as recited in claim 11 wherein the drive mechanism provides for flipping the medium so that a second side of the medium can be printed automatically after a first side of the medium is printed.

13. An inkjet printer as recited in claim 11 wherein the relatively high-contact area has a contact percentage of at least twice a contact percentage of the relatively low-contact area.

14. An inkjet printer as recited in claim 11 wherein the relatively low-contact area has ribs defining intervening gaps.

15. An inkjet printer as recited in claim 14 wherein the relatively high-contact area is smooth.

16. An inkjet printer as recited in claim 11 wherein the relatively high-contact area is metal.

17. An inkjet printer as recited in claim 11 wherein the relatively high-contact area is a plastic modified with a hydrophobic moiety.

18. An inkjet printing platen as recited in claim 7 wherein the relatively high-contact area is metal.

19. An inkjet printing platen as recited in claim 7 wherein the relatively high-contact area is a plastic modified with a hydrophobic moiety.

20. An inkjet printing process as recited in claim 1 wherein the relatively high-contact area is metal.

21. An inkjet printing process as recited in claim 1 wherein the relatively high-contact area is a plastic modified with a hydrophobic moiety.

* * * * *

UNITED STATES PATENT AND TRADEMARK OFFICE

CERTIFICATE OF CORRECTION

PATENT NO. : 9,126,424 B2
APPLICATION NO. : 13/746161
DATED : September 8, 2015
INVENTOR(S) : Coffin et al.

It is certified that error appears in the above-identified patent and that said Letters Patent is hereby corrected as shown below:

In the claims

Column 5, line 50, Claim 7, delete “area” and insert -- area; --, therefor.

Column 5, line 54, Claim 7, delete “are” and insert -- area --, therefor.

Column 6, line 26, Claim 11, delete “are” and insert -- area --, therefor.

Signed and Sealed this
Seventh Day of June, 2016

Michelle K. Lee

Michelle K. Lee
*Director of the United States Patent and Trademark Office*